United States Patent [19]

McLennan

[11] 3,999,254

[45] Dec. 28, 1976

[54] TWO-PIECE LOCKING BUCKLE

[75] Inventor: Richard E. McLennan, Rancho Palos Verdes, Calif.

[73] Assignee: Satron, Inc., El Segundo, Calif.

[22] Filed: May 21, 1975

[21] Appl. No.: 579,438

[52] U.S. Cl. ..... 24/196; 24/74 R

[51] Int. Cl.[2] ..... A44B 11/10

[58] Field of Search ..... 24/68 CD, 68 BT, 68 SB, 24/68 E, 265 CD, 74 R, 75, 181, 171, 194, 196, 193, 197

[56] References Cited

UNITED STATES PATENTS

| | | | |
|---|---|---|---|
| 760,885 | 5/1904 | Loos | 24/74 R |
| 807,013 | 12/1905 | Brown | 24/194 |
| 1,059,303 | 4/1913 | Kerngood | 24/74 R |
| 1,514,227 | 11/1924 | Prentice | 24/196 |
| 2,807,852 | 10/1957 | Rave | 24/197 |
| 3,178,785 | 4/1965 | Jellison | 24/68 CD |
| 3,407,452 | 10/1968 | Abert et al. | 24/197 |

FOREIGN PATENTS OR APPLICATIONS

| | | | |
|---|---|---|---|
| 58,191 | 10/1967 | Germany | 24/74 R |

*Primary Examiner*—Donald A. Griffin
*Attorney, Agent, or Firm*—George F. Smyth

[57] ABSTRACT

A releasable locking type buckle is made of two pieces of essentially flat material, the pieces forming two members which cooperate with preferably webbed type belts to form a securing assembly usable as a cargo securing device. One of the locking members receives a preferably webbed type belt fixedly secured thereto, while the other locking member includes a loop receiving portion, an end of which is fixedly secured. The second member is slidable along the first member between a locking position and an unlocking position. The loop includes a first leg positioned against the underside of the first member and is looped over the loop receiving portion of the second member with a second leg of the loop spaced from the first leg. By pulling the first leg of the loop, the second member is caused to slide along the first member with the web being gripped between the loop receiving portion and a fixed locking element of the first locking member, the interposed portion of the first leg of the loop being secured therebetween for as long as tension is applied. To release the buckle, the free end of the first locking member is lifted relative to the first leg of the loop.

10 Claims, 6 Drawing Figures

TWO-PIECE LOCKING BUCKLE

BACKGROUND OF THE INVENTION

1. Field of the Invention

This invention relates to a locking buckle, and more particularly to an improved two-piece locking buckle of relatively simple design which is effective as a releasable locking buckle and capable of withstanding substantial loads.

2. Description of the Prior Art

Releasable locking type devices are known in the prior art for use as securing elements with web type belts. In one form of device, a handle is provided with ears which are slotted to receive a movable, knurled locking element around which the webbing is positioned. By applying tension to one leg of the web, the loop is held tight against the knurled surface which is urged into engagement with a portion of the locking element. While this type device operates satisfactorily as a releasable locking element it is objectionable for two principal reasons. First, the expense of knurling the member is substantial as is the expense of assembling the knurled member within the slots provided in the ears.

With the device of the type above described, there is the further objection, especially in the field of cargo handling and restraint that the device may be damaged if accidentally run over by a fork lift truck, a type of equipment frequently used in the handling of cargo, or if a heavy object falls on it.

Another type of locking device used is one in which a knurled member is slotted and moves in a guideway. This type of device, while functioning satisfactorily is somewhat expensive to manufacture due to the knurling and the need to assemble the various pieces into a single structure. This type of device is also subject to damage.

Another type of locking device is referred to as a double D ring. This type of device is known in the prior art but suffers from the disadvantage that it is difficult to handle such double D ring type locking devices especially in the release thereof. Furthermore, these types of devices have the disadvantage that there are limitations on the load carrying ability of such devices.

Accordingly, it can be seen that the provision of an effective, durable releasable locking type buckle which is inexpensive to manufacture, which is made of a minimum number of pieces, and which is essentially flat, offers substantial advantages, particularly for use as a restraining releasable type buckle in cargo handling and restraint.

SUMMARY OF THE PRESENT INVENTION

The relatively simple and effective releasable locking type buckle of the present invention is principally a two-piece buckle including a first locking member, one end of which receives a securing element in the form of a webbing or rope-like material. Cooperating with the first locking member is a second locking member received on one surface of the first member and slidable along the surface of the first member between a locking position and an unlocking position.

The second locking member includes a loop receiving member positioned above one surface of the first locking member for receiving a securing member in the form of a belt or rope that is looped over the loop receiving member such that one leg of the loop is positioned on the underside of the first locking member while the second leg of the loop, which extends in the same direction as the first leg, is spaced from the underside of the first member. The first locking member includes a fixed locking element positioned below the second locking member and operative, as tension is applied to the second leg of the loop, to lock the first leg of the loop between the loop receiving member and the locking element to lock the webbing or rope in tension.

Each of the locking members is preferably formed of flat sheet stock and therefore, the entire locking device with the associated ropes or webs is essentially quite flat. Since the locking device consists principally of two pieces, in sliding relationship with a strap loop, the assembly costs thereof are substantially reduced. Due to the flatness of the locking member, should a fork lift truck or other vehicle accidentally roll over, or a heavy object fall upon, the device of the present invention, there is little if any damage to the locking members or any substantial interference with their function as a locking member.

Among the significant advantages of the present invention is the fact that there is no knurling required for the parts, a fact which substantially reduces the cost of manufacture. Moreover, because of the relative simplicity of the parts, the components thereof may be fabricated from sheet stock by a stamping operation, with no assembly time for assembly of the metal components of the buckle, contrary to buckles of the described prior devices, and only minimal assembly for attachment of the webbing.

DESCRIPTION OF THE PREFERRED EMBODIMENT

Figures 1, 2, 3:
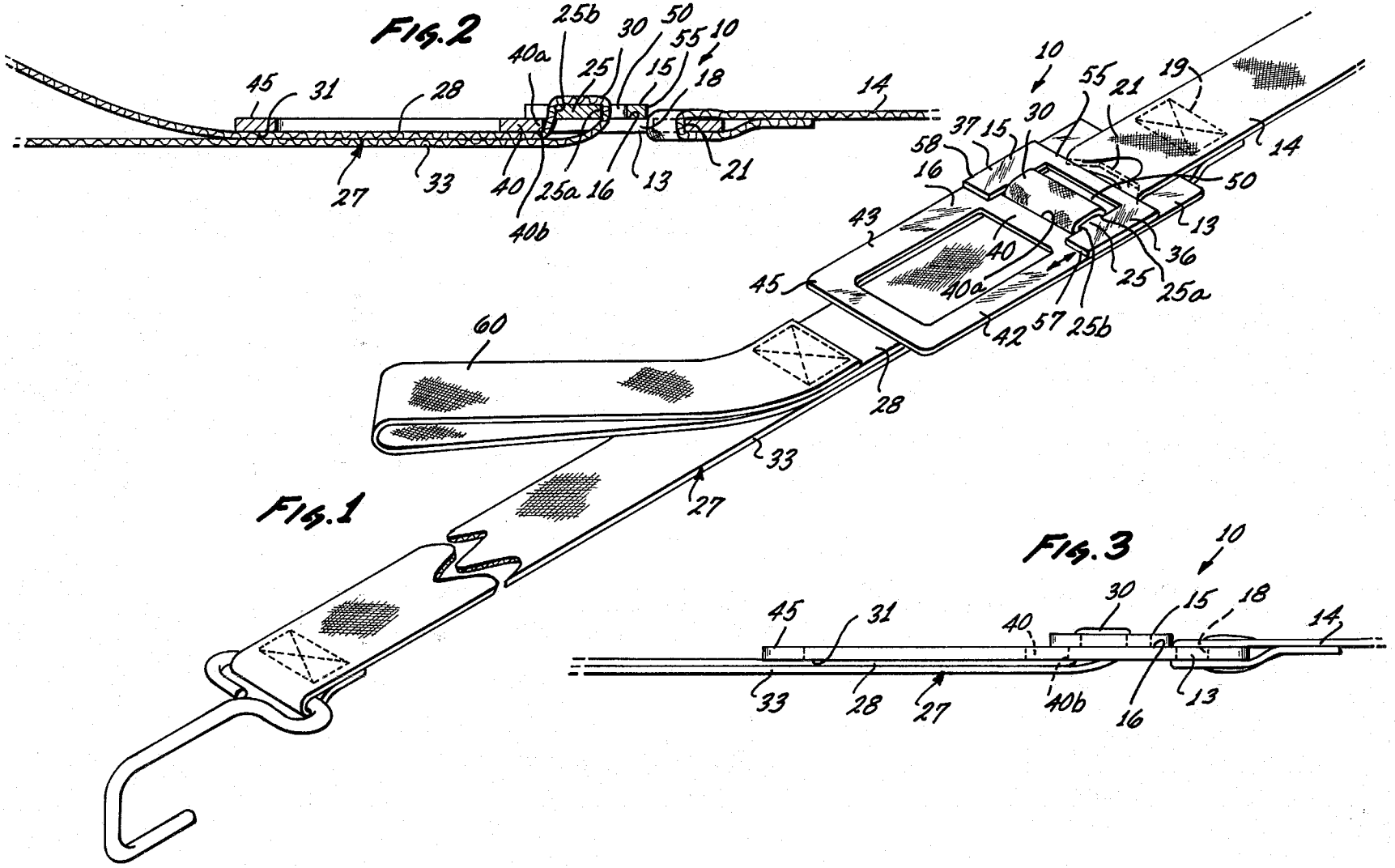
FIG. 1 is a view in perspective of a locking device and attached securing elements in accordance with the present invention.
FIG. 2 is a side view of the device illustrated in FIG. 1.
FIG. 3 is a sectional view illustrating the locked position of the locking device in accordance with the present invention.

Referring to the drawings which illustrate an exemplary embodiment of the preferred form of the present invention, FIG. 1 shows a two-piece locking device generally designated 10 in accordance with the present invention. The two-piece locking device includes a first locking member 13 which receives a belt-like securing element 14 on one end thereof, although it is understood that the securing element may be in the form of rope or other device. In normal practice, the free end of the securing element is attached to a stationary member.

Cooperating with the first locking member 13 is a second locking member 15 which is received on the upper surface 16 of the first locking member. The second locking member 15 is slidable along the surface 16 between a locking position and an unlocking position.

As illustrated, the first locking member 13 is generally rectangular in overall shape, although other shapes may be used, such as a square and the like, as is also true with respect to the shape of the second locking member.

Referring to FIGS. 1 and 2 it will be seen that one end of the first locking member is provided with an aperture generally indicated 18 such that the load securing element 14 may be looped over the end of the first member and attached thereto by stitching 19 as indicated, it being understood that the other means of affixing a securing element may be used. As shown in FIG. 1, the inner face 21 of the inner surface of the first locking member 13 is generally curved so as to center the load securing element with respect to the first locking member 13.

The second securing element 15, which is slidable in the direction indicated by the arrows in FIG. 1 along surface 16, includes a loop receiving member 25 which extends transversely across the first locking member and is positioned above surface 16.

A load securing member 27 is looped over the loop receiving member 25 such that one leg 28 of the loop 30 is positioned against the underside 31 of the first locking member 13 while a second leg 33 of the loop 30, extending in the same direction as the first leg, is positioned in spaced relationship to the underside of the first member by the first leg 28 of the loop 30. As illustrated, the transverse dimension of the securing element 27 is approximately equal to that portion of the loop receiving member which extends from side arms 36 and 37 which are integrally formed with the loop receiving member 25.

The first locking member 13 also includes a fixed locking element 40 extending between side frame members 42 and 43 of the first locking member 13.

As shown in FIG. 2, the locking member 40 is positioned below the second locking element 15 and is operative, as tension is applied to the second leg 33 of the loop to lock the first leg 31 between the loop receiving member 25 and the locking member 40 thereby effecting a locking of the securing elements in tension.

Referring to FIGS. 3 to 6 and wherein like reference numerals have been used where applicable, the locking operation of the improved buckle of the present invention may be understood more clearly. In normal usage, members 14 and 28 are each secured to some stationary member, such as cargo or decking or the like. It is understood, however, that member 14 may be an end of member 28 such that a loop is formed.

As will be apparent, as leg 27 of the loop 30 is pulled, assuming that members 14 and 33 are secured, the overall length of the members 14 and 33 are effectively decreased to restrain the cargo or other item being secured. As the slack is taken up, the second locking member 15 tends to slide along the top surface 16 of the first locking member 13 by virtue of the fact that the loop receiving member 25 is being pulled to the left as viewed in FIG. 3. The pulling motion exerts a force which tends to pull the locking member 15 through the opening 18 but such movement is restrained by the side frame member 42 and 43 which operate as bearing surfaces for side arms 36 and 37 thereby resulting in a sliding movement to the left as viewed in FIGS. 3 and 4.

As such sliding movement takes place, the loop receiving member 25 tends to slide past the fixed locking element 40. If the loop were not present, this would occur, that is, a force exerted to the rear 25*a* of the loop member 25 occurs by pulling or tension of leg 28 of the loop 30. The greater the pulling force or tension, the greater the force tending to urge the loop ring member across surface 16. Since that portion of the loop which is free, i.e. the first leg 28 located between the rear face 40*a* of the fixed locking element, the force tends to lock the opposed portions of the leg between the rear face 40*a* and the forward face 25*b* of the loop receiving member. In this relative position, the leg of the loop is firmly engaged.

Figure 4:
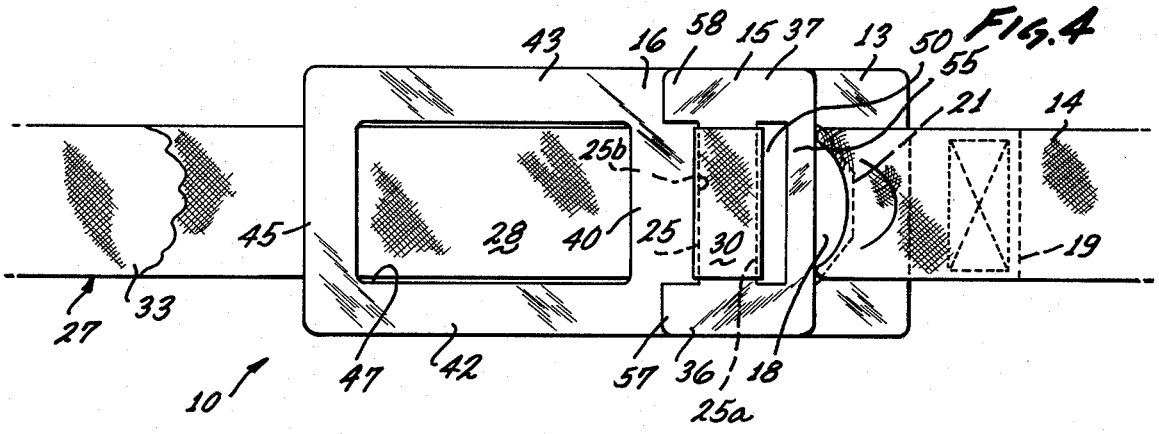
FIG. 4 is a plan view, similar to FIG. 3 showing the locked position of the locking device of the present invention.

The second locking member is not capable of moving vertically upward relative to the first member 13 since the tension force applied also results in a downward force component, as viewed in FIGS. 3 and 4. Thus, as long as tension is applied and legs 28 and 33 are in parallel contacting relation to each other and to member 13, the buckle remains locked.

Figure 5:
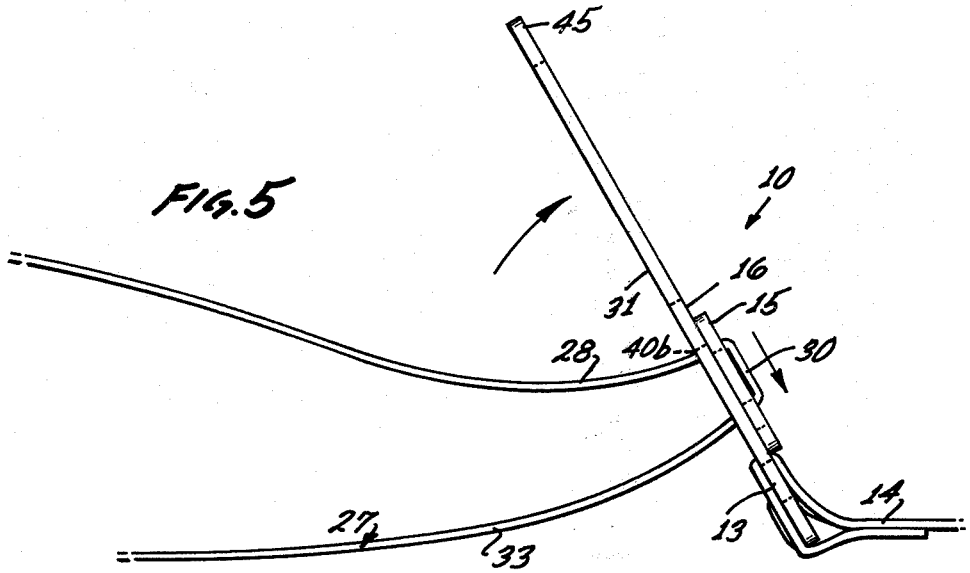
FIG. 5 is a diagrammatic view illustrating the unlocking of the locking device in accordance with the present invention.

To release the buckle, the parallel contacting relation is altered. This may be accomplished by lifting the free end 45 of the first member 13, to a position as shown in FIG. 5, or by lifting leg 28 and the free end 45 away from the leg 33. The result is to cause member 15 to move to the rear of member 13, thereby separating the locking faces 40*a* and 25*b*. Since there is a downward force component, as described, altering the relative parallel relation results in the downward force pulling the member 15 to the right as viewed in FIGS. 3–5. Relocking is accomplished by pulling on the leg 28.

Referring specifically to FIG. 3, it will be seen that the second leg 33 of the loop also urges a portion of the first leg 28 into contact with the lower corner 40*b* of the fixed locking member 40 in addition to the locking function already described. While this is a secondary locking action, it is somewhat effective because the web is in tension and the locking members are vertically displaced, one over the other.

Figure 6:
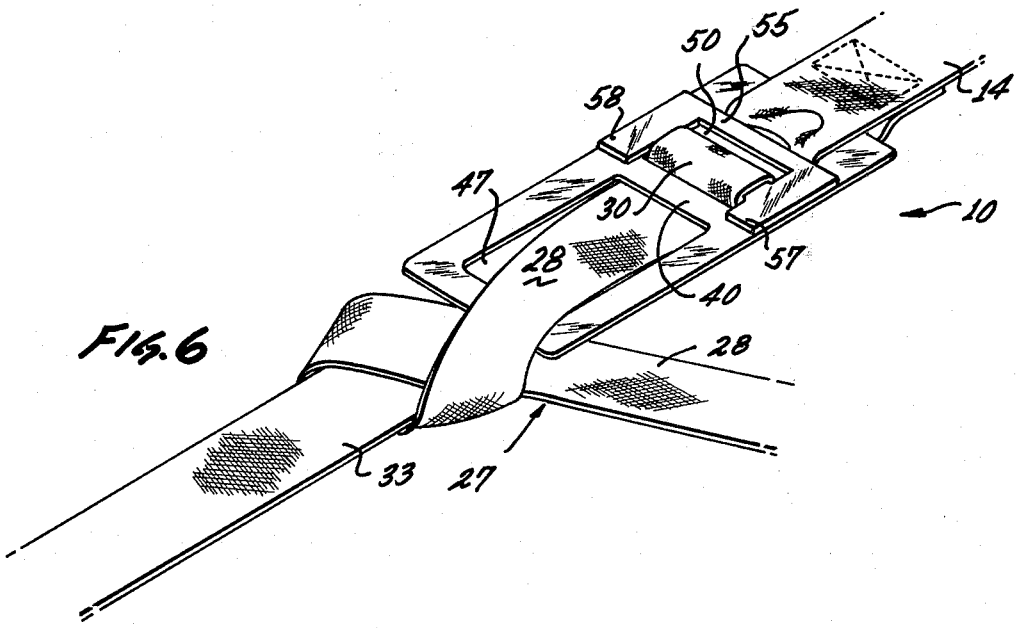
FIG. 6 is a view in perspective illustrating the manner which the tension members may be used to assure that the locking device of the present invention remains in the flat and thus locked position, in accordance with the present invention.

Since lifting of the free end 45 effects release, the simple construction of the present invention also provides the possibility of securing the free end in parallel relation by using the first leg to tie the free end in place as shown in FIG. 6. There, the first leg 28 of the loop is fed through the underside of an opening 47 provided adjacent the free end and secured to the second leg 33 as shown. Other securing means may be used if desired, but are not necessary for the proper operation of the buckle of this invention. Such securing merely affords added protection against accidental or unintentional release.

It will also be seen from FIG. 6 that the second locking member is provided with a second cross member 55 spaced from the locking member 25 to provide an aperture 50 through which the loop passes. While not necessary to the function of the buckle of this invention, cross member 55 adds strength and provides a simple manner to assure that the parts remain together and cannot be separated. To this end, the dimension between face 25*b* and the opposing face 25*a* forming the longitudinal dimension of opening 50 is less than twice the cross-sectional thickness of the web. Thus, by sewing a double thickness of web, for example, to form a loop 60 (FIG. 1) the free end of first leg 28 cannot pass through the opening 50 which could conceivable result in loss of member 15 from the buckle.

It will also be apparent that the transverse dimension of apertures 18, 47, and 50 are selected to be approximately that of the transverse dimension of the web so that all loops and legs remain flat as opposed to twisted.

Moreover, as will be seen from the drawings e.g. FIG. 6, if the second member 15 becomes flipped over, e.g. oriented such that legs 57 and 58 are pointed to the right, the buckle still functions in the same identical manner described except that the rear face 25*c* now forms the locking face.

As mentioned earlier, the relatively simple operation of the present buckle and its efficient operation derives in part from formation of the parts from flat sheet like stock. As can be seen from FIGS. 2 and 3, the entire assembly is relatively flat with no upstanding ears and the like which can be bent if accidentally run over by a vehicle, such as a fork-lift truck, or if a heavy object is dropped on the buckle.

Being made of flat stock, the manufacture of the buckle is relatively simple, e.g. by stamping operations. Thus, stamping may be used to form aperture 18. The section stamped to form aperture 47 may in turn be used to form member 15, by stamping out the end slot and slot 50. Thus, from one rectangular piece, the metal elements of the buckle may be easily formed. After the stamping action, the parts are preferably tumbled in a grit to remove any sharp edges, especially those at the junction of faces 25*a* and 40*a*. After tumbling, the webs are assembled and fixed in place. It will be understood that other methods may be used to form the parts, e.g. machining, casting, etc., but stamping probably is the least expensive.

It will also be understood that the flat stock may be of steel, aluminum and the like or of high strength plastics, depending on the loads which the assembly is intended to handle. Where rope is used in place of webs, the transverse dimension of the parts should be proportioned so that loops are formed and maintained.

While exemplary embodiments of the invention have been shown and described, many changes, modifications and substitutions may be made by one having ordinary skill in the art without necessarily departing from the spirit and scope of this invention.

I claim:

1. A two-piece releasable locking type buckle for use with securing elements adapted to secure cargo and the like wherein tension on the securing elements effects locking, comprising:

a first flat locking member including spaced side frame members and having means at one end to receive a securing element, a second flat locking member cooperating with said first locking member and received on one surface of said first member and slidable along said surface to a locking position and in the opposite direction to an unlock position, said second locking member including spaced side arms which overlie said spaced side frame members of said first locking member, said second locking member including a loop receiving member fixed in position transversely across said spaced side arms and positioned above said one surface of said first member for receiving a securing member that is looped thereover such that one leg of said loop is positioned on the underside of said first locking member while the second leg of the loop extends in the same direction as the first leg and is spaced from said underside by the first leg, said first locking member including a locking element fixed in position across said side frame members and positioned below said second locking member and operative as tension is applied to the second leg to lock the first leg between said loop receiving member and said locking element thereby locking the securing elements in tension, and said first locking element including a free end spaced from said locking element and said loop receiving member and operative in response to movement thereof away from said second leg of said loop to effect sliding movement of said second locking member and said loop receiving member away from said locking element to release tension on said securing elements.

2. A two-piece, releasable locking type buckle as set forth in claim 1 wherein each of said first and second locking members is of flat sheet stock.

3. A two-piece, releasable locking type buckle as set forth in claim 2 wherein said second locking member includes leg portions which extend beyond loop receiving portions and which bear against the one surface of said first locking member to provide sliding movement of said second locking member relative to the first locking member.

4. A two-piece, releasable locking type buckle as set forth in claim 1 wherein said first locking member is longer than said second locking member, said first locking member including an opening therein located between said lifting end and said locking element.

5. A two-piece, releasable locking type buckle as set forth in claim 1 wherein the locking position of the buckle is defined by the relative position of said first locking member with respect to the first leg and the position of said loop receiving portion with respect to said locking element whereby as long as tension is applied to the tension elements and said first locking member is in contact with one of the legs, the buckle remains locked.

6. A two-piece, releasable locking type buckle as set forth in claim 1 wherein application of tension on the first leg of the loop causes tension to be applied to the second leg of the loop whereby said loop receiving member tends to move axially and downwardly through said first locking member to effect locking of the securing elements by engagement with the portion of the first leg of the loop located between the loop receiving member and the fixed locking element.

7. A two-piece, releasable locking type buckle as set forth in claim 1 wherein each of said loop receiving member and said fixed locking element includes a locking face which engages the first leg of the loop to hold the securing elements in tension, and said locking faces each being smooth surfaces.

8. A two-piece releasable locking type of buckle as set forth in claim 1 wherein said loop receiving member includes a generally flat leg engaging face and adjacent flat surfaces on each side thereof, the junction between said flat faces being rounded to reduce the tendency of said loop receiving member to cut through the first leg of the loop in the locked position.

9. A two-piece, releasable locking type of buckle as set forth in claim 1 wherein the locking position of said buckle is defined by that relative position of the parts in which the loop receiving member is urged axially towards said fixed locking member whereby the first leg of the loop is secured therebetween.

10. A two-piece, releasable locking type buckle as set forth in claim 1 wherein said first locking member includes a free end opposite means to receive a securing element and operative upon movement thereof away from the first leg of the loop to effect movement of second locking member away from said free end to an unlock position.

* * * * *